US012085081B1

(12) United States Patent
Malone

(10) Patent No.: US 12,085,081 B1
(45) Date of Patent: Sep. 10, 2024

(54) FLUID PUMP AND VALVE SWITCH

(71) Applicant: Cooper-Standard Automotive Inc., Northville, MI (US)

(72) Inventor: David S. Malone, Attica, MI (US)

(73) Assignee: Cooper-Standard Automotive Inc., Northville, MI (US)

( * ) Notice: Subject to any disclaimer, the term of this patent is extended or adjusted under 35 U.S.C. 154(b) by 0 days.

(21) Appl. No.: 18/473,231

(22) Filed: Sep. 23, 2023

(51) Int. Cl.
*F04D 15/00* (2006.01)
*F04D 13/06* (2006.01)
*F04D 29/42* (2006.01)

(52) U.S. Cl.
CPC ..... *F04D 15/0016* (2013.01); *F04D 13/06* (2013.01); *F04D 29/4293* (2013.01)

(58) Field of Classification Search
CPC ... F04D 15/0016; F04D 13/06; F04D 29/4293
See application file for complete search history.

(56) References Cited

U.S. PATENT DOCUMENTS

| | | | | |
|---|---|---|---|---|
| 4,679,983 | A * | 7/1987 | Pietryk | F04D 29/486 415/152.2 |
| 5,145,333 | A * | 9/1992 | Smith | A61M 60/825 416/223 R |
| 8,443,765 | B2 | 5/2013 | Hollis | |
| 9,752,493 | B2 | 9/2017 | Malone | |
| 10,823,175 | B2 | 11/2020 | Blad et al. | |
| 11,333,151 | B2 * | 5/2022 | Blad | F04D 1/006 |
| 2004/0173249 | A1 * | 9/2004 | Assmann | F04D 15/0016 134/179 |
| 2018/0010609 | A1 * | 1/2018 | Jensen | F04D 29/4293 |
| 2018/0291908 | A1 * | 10/2018 | Blad | F04D 29/486 |
| 2020/0072238 | A1 * | 3/2020 | Blad | F04D 13/06 |
| 2020/0158351 | A1 * | 5/2020 | Blad | F04D 15/0027 |
| 2020/0340684 | A1 * | 10/2020 | Blad | F04D 15/0016 |
| 2021/0003133 | A1 * | 1/2021 | Blad | F04D 29/486 |
| 2023/0167826 | A1 * | 6/2023 | Jensen | F04D 1/006 415/152.1 |
| 2023/0194005 | A1 * | 6/2023 | Jensen | F16K 11/074 415/148 |

FOREIGN PATENT DOCUMENTS

| | | | | |
|---|---|---|---|---|
| CN | 113464441 | A * | 10/2021 | |
| CN | 114905914 | A * | 8/2022 | |
| DE | 102019202975 | A1 * | 9/2020 | |
| DE | 112020001954 | T5 * | 12/2021 | F16K 11/02 |
| EP | 0636791 | A1 * | 2/1995 | |
| FR | 3075551 | A1 * | 6/2019 | |
| JP | 2023114030 | A * | 8/2023 | |
| WO | WO-2009070565 | A1 * | 6/2009 | F04D 15/0016 |
| WO | WO-2017207951 | A1 * | 12/2017 | F04D 15/0005 |

* cited by examiner

*Primary Examiner* — Dominick L Plakkoottam
(74) *Attorney, Agent, or Firm* — Paschall & Associates, LLC; James C. Paschall; Anthony Miologos

(57) ABSTRACT

An assembly comprising a housing having a first and a second fluid inlet for directing fluid to a pump cavity. A valve switch located in the housing is arranged to selectively switch the flow of the fluid between the second fluid inlet and the pump cavity. A fluid outlet is fluidically connected to the pump cavity and an impeller contained in the pump cavity is arranged to be rotated on demand by an electrical motor that accelerates the fluid in the pump cavity out of the fluid outlet.

21 Claims, 8 Drawing Sheets

FLUID PUMP AND VALVE SWITCH

TECHNICAL FIELD

This disclosure is generally directed to pumps. More specifically, it relates to an assembly of a fluid pump and valve switch wherein the fluid pump can be selectively energized to pump fluid from the pump and the valve switched to control the flow of fluid to the pump.

BACKGROUND

In motor vehicles, in order to circulate coolant in a coolant circuit between the vehicle radiator and the internal combustion engine, mechanically driven coolant pumps are generally used. The coolant pumps are arranged between the vehicle radiator and the internal combustion engine driven by a belt using the drive power of the internal combustion engine. Current vehicle design in the automotive sector is directed towards increasing the fuel-efficiency of vehicles. For this purpose, for example, start-stop systems are used, which an internal combustion engine in the vehicle, for example when stopping at a red light, a railway barrier, etc., is temporarily switched off. As soon as the stop situation has ended, and the vehicle operator presses the gas pedal, the internal combustion engine is restarted. Due to the system-related shutdown of the internal combustion engine in such start-stop systems the operation of the coolant pump is also stopped. In particular, due to the stopping of the internal combustion engine no more drive power is transmitted by the belt drive to the mechanical coolant pump, so that its operation is stopped, and therefore no coolant is circulated in the coolant circuit. During high outside temperatures and at correspondingly high engine or coolant temperatures, stopping the circulation of coolant flowing in the coolant circuit due to the stopped engine can cause the temperature of the engine to rise beyond a safe permitted level.

Additionally, in conventional coolant circuits, much of the thermal energy in the circulating coolant is typically dissipated to the air by a heat exchanger, such as the radiator, heater core or a transmission oil cooler. Under normal operating conditions, an engine and transmission may only require nominal coolant flow to maintain proper temperature of internal components. However, under severe operating conditions an engine may require an increased coolant flow to maintain proper component temperatures. If a high flow rate coolant pump is used to provide a high coolant flow rate under severe conditions to prevent overheating, the amount of coolant flow will be excessive under normal operating conditions, resulting in parasitic energy losses within the engine and transmission. Under cold start conditions, an engine and transmission may also require increased coolant flow to achieve and maintain proper temperature of internal components.

In currently known coolant circuits used in engine driven vehicles separate auxiliary pumps and inlet switching valves are used with branched coolant circuit lines to provide auxiliary fluid pump flow and to switch coolant flow to the heat dissipating components of the vehicle, which results in high component costs. Therefore, it is an object of the present disclosure to provide a fluid pump and valve switch wherein the fluid pump can be selectively energized to pump fluid from the pump on demand and the valve switched to control the flow of fluid to the pump using a minimal set of components.

SUMMARY

This disclosure relates to an assembly of a fluid pump and valve switch wherein the fluid pump can be selectively energized to pump fluid from the pump and the valve switched to control the flow of fluid to the pump.

The assembly comprises a housing having at least a first and a second fluid inlet for directing a fluid to a pump cavity. A valve switch located in the housing is arranged to selectively switch the flow of the fluid between the second fluid inlet and the pump cavity. A fluid outlet is fluidically connected to the pump cavity. An impeller contained in the pump cavity is arranged to be rotated on demand by an electrical motor to accelerate the fluid in the pump cavity out of the fluid outlet.

The valve switch is arranged to be rotated by an actuator into a first position that aligns an opening with the second fluid opening. The alignment causes fluid to flow from the second fluid opening through the opening into the pump cavity. The valve switch is further arranged to be rotated by the actuator into a second position that moves the opening away from the second fluid inlet blocking fluid from flowing to the pump cavity. The electrical motor and the actuator receive control signals and electrical energy from an external controller that energizes the electrical motor to rotate the impeller to accelerate the fluid in the pump cavity and rotate the actuator to position the valve switch.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
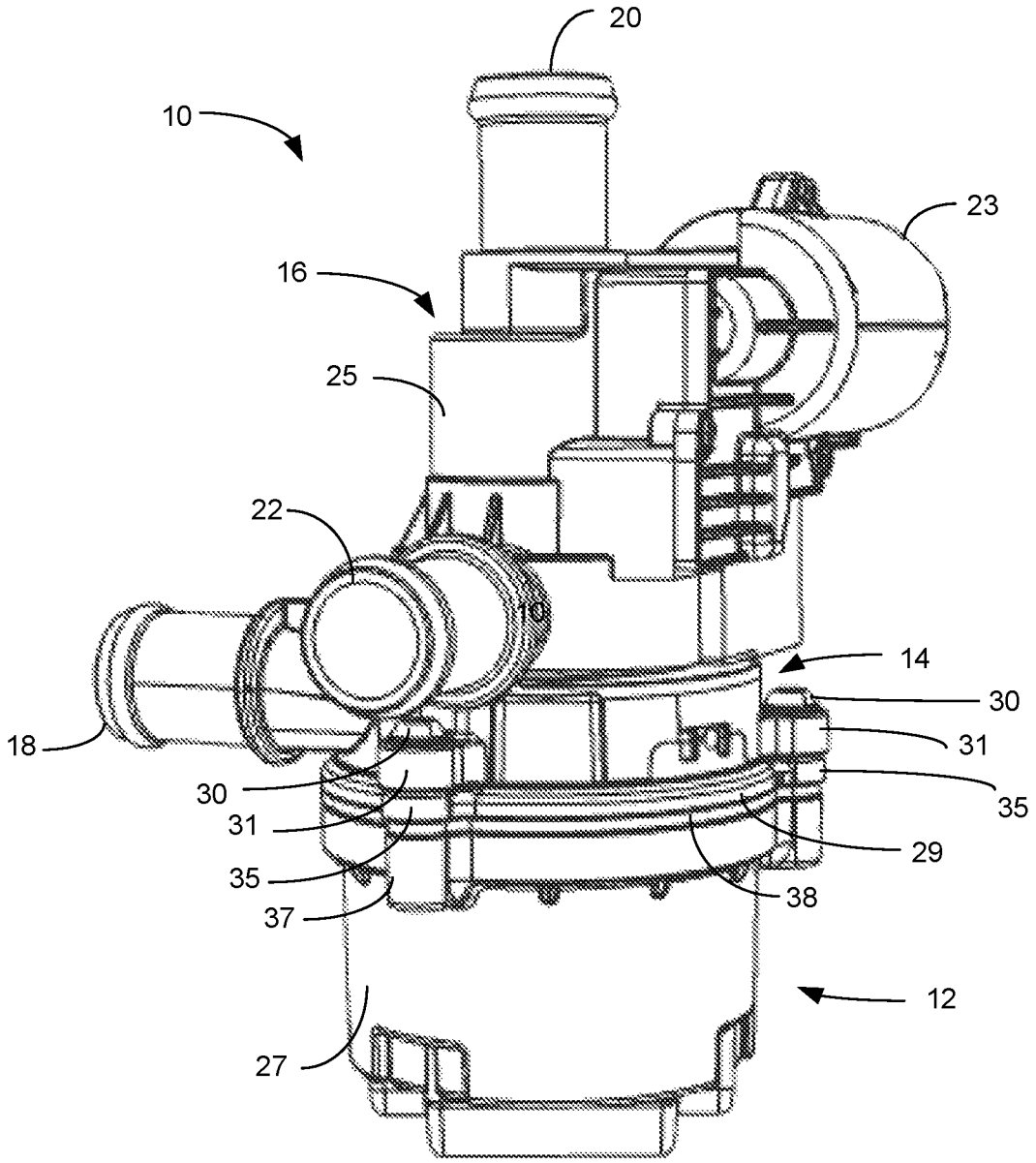
FIG. 1 illustrates a perspective view of the assembly of an integrated fluid pump and valve switch of the present disclosure.

The figures discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

The assembly of an integrated fluid pump and valve switch of the present disclosure is arranged to be used in a coolant circuit that manages heat energy in a vehicle powertrain. A vehicle powertrain typically includes an engine and a transmission. Heat energy produced by the engine is drawn from the engine by coolant circulating in the vehicle's engine through a series of coolant passageways including an engine coolant inlet and an engine coolant outlet. The coolant circuit may include a pump mechanically driven by the engine, a first control valve, a second control valve, a radiator, a heater core, and a transmission oil heat exchanger. Coolant is supplied to the engine via the coolant circuit using the mechanical pump, which has a pump inlet and a pump outlet. The pump outlet is in fluid communication with the engine coolant inlet. Coolant flow to the radiator is controlled by the first control valve that has a first control valve inlet and a first control valve outlet. The first control valve inlet is in fluid communication with the engine coolant outlet. Heat energy is released from the coolant by passing the coolant through the radiator with a coolant inlet in fluid communication with the outlet of the first control valve and a radiator outlet in fluid communication with the mechanical pump inlet.

Heat energy may also be released from the coolant by passing the coolant through the heater core, which has an inlet and an outlet. The inlet of the heater core is in fluid communication with the outlet of the mechanical pump. Heat energy may further be exchanged between the coolant and a transmission oil using the transmission oil heat exchanger. The transmission oil lubricates and exchanges heat energy with the transmission. The transmission oil heat exchanger has an inlet and an outlet with the inlet of the transmission oil heat exchanger in fluid communication with the outlet of the mechanical pump. Coolant flow through the transmission oil heat exchanger is controlled with a second control valve. The heat energy produced by the engine is transferred to the radiator and the heater core through control of the first control valve and from the transmission oil heat exchanger through the outlet of the second control valve to a second inlet of the first control valve.

FIGS. 1-8 illustrate an example assembly 10 of an integrated fluid pump and valve switch of the present disclosure. The assembly 10 includes an electrically driven auxiliary fluid pump that is energized by a stored energy source, such as for example a battery. The auxiliary fluid pump is selectively operated to drive fluid from a fluid outlet into the vehicle's coolant circuit when the mechanical pump is not operating, such as when for example the engine is in a temporarily stopped situation. As soon as the stop situation has ended, the mechanical pump resumes its operation upon restarting of the engine, and the auxiliary fluid pump operation is halted. The assembly further includes at least a first and a second fluid input. One of the first or the second fluid inputs is arranged to be switched to allow fluid to flow through the switched fluid input to the fluid outlet. As can be appreciated, the assembly 10 of the present disclosure may also be used in other non-vehicle applications requiring an assembly of a selectively energized auxiliary pump for the transfer of fluids by the pump integrated with an inlet valve that can be switched to control the flow of fluid to the pump.

Figure 2:
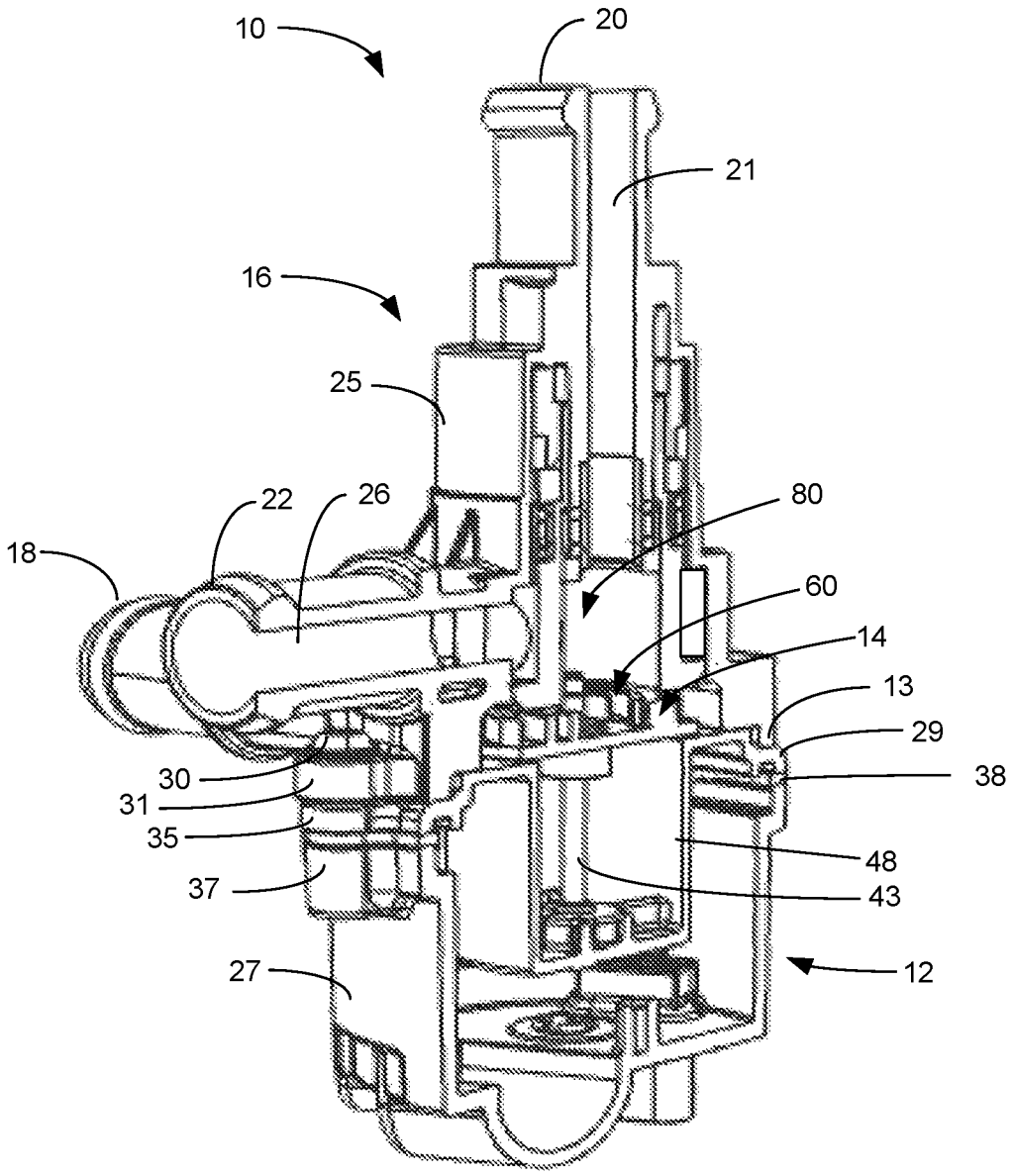
FIG. 2 illustrates a cross-sectional perspective view through the assembly of FIG. 1 of the present disclosure.

FIGS. 1 and 2 illustrate example assembly 10 of the integrated fluid pump and valve switch of the present disclosure. The assembly 10 comprises a motor section 12, a valve section 16, and a pump section 14. A first fluid inlet 20 extends outward from the pump section 16 providing a non-switched fluid inlet to the pump section 14 through a passage 21 that extends through valve section 16. The first fluid inlet 20 may be connected via a coolant line (not shown) to the vehicles heat exchanger. A second fluid inlet 22 includes a passage 26 that extends into the valve section 16 and to a valve switch 80. The valve switch 80 is arranged to be switched into an open or closed position to permit or to block fluid to flow to the pump section 14 from the second fluid inlet 22. The second fluid inlet 22 is connected via coolant line (not shown) to another of the vehicles heat exchangers, such as for example, the transmission oil heat exchanger. An actuator motor 50 is housed in an actuator cover 23 mounted on the valve section 16. The actuator motor 50 is arranged to rotate the valve switch 80 to position the valve switch into the open or closed position when the actuator motor 50 is energized by a vehicle control circuit.

The valve section 16, first inlet port 20, second inlet port 22, pump section 14 and outlet port 18 are integrated into a singular upper housing 25 formed from a suitable glycol and temperature resistant thermoplastic material. The actuator cover 23 housing the actuator motor 50 is attached to the upper housing by suitable fasteners, such as for example threaded screws (not shown).

The motor section 12 includes a lower housing 27 and an intermediate cover member 29. A top surface of the intermediate cover member 29 forms a floor for the pump section 14. An impeller 60 is rotationally mounted over the floor and is enclosed within a pump cavity 62 formed in the interior of the pump section 14. A chamber 48 extends from a bottom surface of the intermediate cover member 29. Chamber 48 houses a motor shaft 43 that may be attached to the rotor of an electrical motor. The electrical motor is not shown in FIG. 2 in order to clearly show the motor shaft 42, however, the electrical motor will be explained in detail with the explanation of FIG. 3. The motor shaft 43 is attached to the impeller 60. The electrical motor is arranged to rotate the motor shaft 43 which in turn rotates the impeller 60.

The intermediate cover member 29 and the lower housing 27 are attached to the upper housing 25 using threaded fasteners 30. The treaded fasteners 30 extending through complementary holes located through plurality of mounting flanges 31 located along a lower peripheral portion of the lower housing and through complementary holes in mounting flanges 35 of the intermediate cover member 29. Each threaded fastener 30 engages an associated threaded hole formed in attachment members 37 located along the upper periphery of the lower housing 27. An elastomeric sealing gasket 38 is placed between the intermediate cover member 29 and the lower housing to provide fluid isolation between the pump section 14 and the electrical components in the motor section 12. The actuator cover 23, intermediate cover member 29 and lower housing 27 are all composed of the same glycol and temperature resistant thermoplastic material that comprises the upper housing 25.

Figure 3:
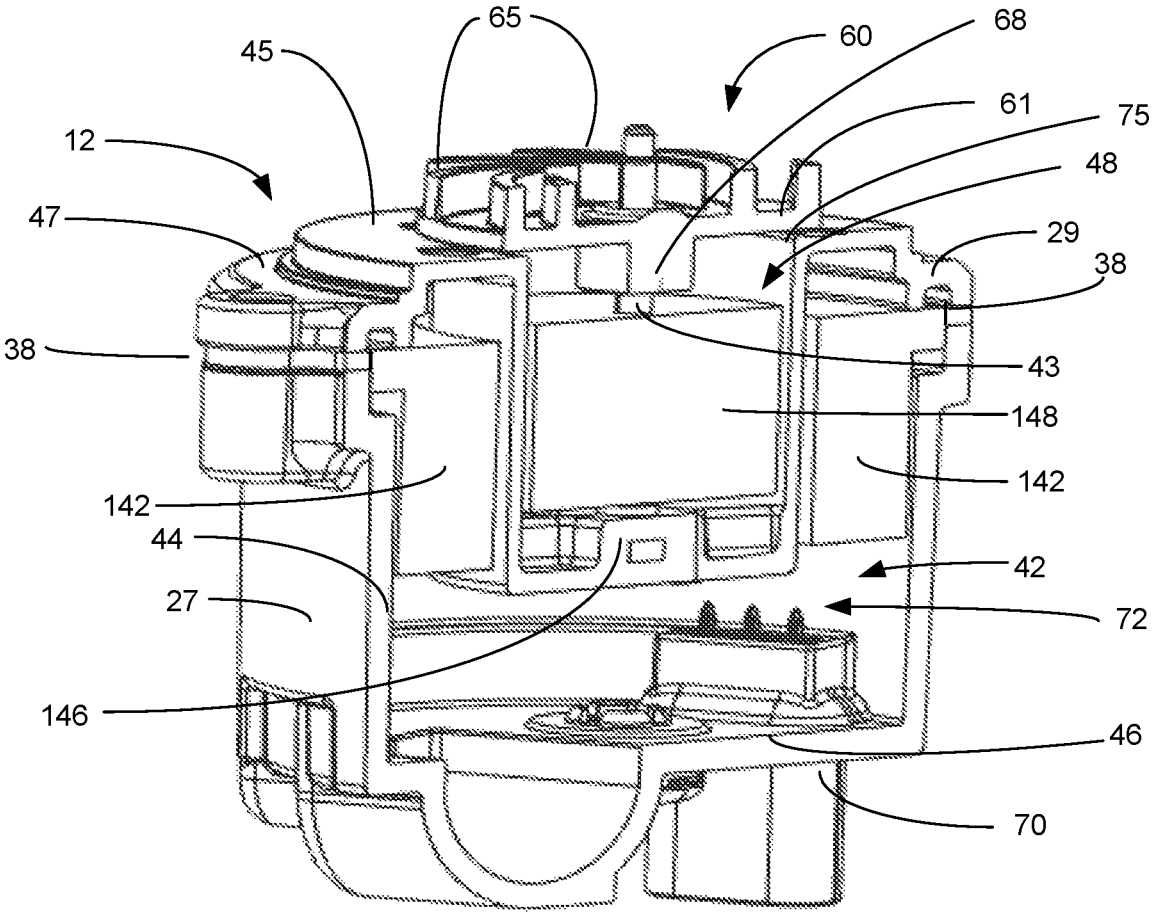
FIG. 3 illustrates a cross-sectional perspective view of the motor section of the present disclosure.

FIG. 3 illustrates an example of the interior of the motor section 12. The motor section 12 is shown configured to house a brushless DC electrical motor (BLDC), however, the motor section 12 may also house a conventional brushed motor. The motor section 12 comprises a cylindrical interior space 42 defined by a circular interior wall 44 and a floor 46. The intermediate cover member 29 has an annular stepped top surface including a first portion 45 and a second portion 47. The first portion 45 forms the floor of the pump section 14. The second portion 47 provides a surface suitably arranged to have a bottom portion 13 of the upper housing 25 rest on second portion 47 when the upper housing and intermediate cover member are attached to the lower housing 25. An opening 75 extends through the first portion 45 to cylindrical chamber 48. The chamber 48 extends from the bottom side of the intermediate cover member 29 into interior space 42.

The chamber 48 is arranged to house a permanent magnet subassembly, comprising a rotor 148 of the BLDC motor. The rotor 148 is attached to the motor shaft 43. The motor shaft 43 includes a first end rotationally attached to a support member 146 located on a floor of the chamber 48 and a second end attached in any convenient manner to a cylindrical attachment member 68 located on a bottom surface of a circular base member 61 of impeller 60. A plurality of vanes 65 extend from a top surface of the base member 61 from a location near the base member 61 center to an outer edge of the base member. The rotor 148 of the BLDC motor rotates within chamber 48 causing the motor shaft 43 to rotate the impeller 60.

The BLDC motor further includes a subassembly of laminated steel plates with copper windings forming a stator 142 of the BLDC motor. The stator 142 is located in interior space 42 surrounding chamber 48 and the rotor 148. The copper winding stacks of the stator 142 are electrically connected in a three phase arrangement (not shown) to a set of terminals 72 that extend into interior space 42 from an external connector housing 70. The terminals 72 provide control signals and electrical energy from an external BLDC controller to drive the BLDC motor. The electrical energy provided for example from the vehicle's battery. The stator subassembly 142 and the interior space 42 are isolated from fluid in the pump section 14 by the wall forming chamber 48. Fluid that may migrate into chamber 48 does not seep into interior space 42.

The electrical connector housing 70 extends through floor 46 from the exterior of lower housing 27 into interior space 42. The set of electrical terminals 72 extend through the connector housing 70. The connector housing 70 is arranged to receive an electrical connector (not shown) to connect the terminals 72 to the BLDC controller that provides the control signals as electrical pulses of current to the winding stacks to control the speed and torque of the BLDC motor. It will be understood that the three phase DC signals to the winding stacks may also be developed internally by appropriate control circuitry may be located on a circuit substrate mounted to the floor 46 of the motor section 12. A circular elastomeric sealing gasket 38 is placed between the intermediate cover member 29 and the lower housing 27 to further provide fluid isolation to the stator subassembly 142 of the BLDC motor and electrical terminals 72 located in the motor section 12.

Figure 4:
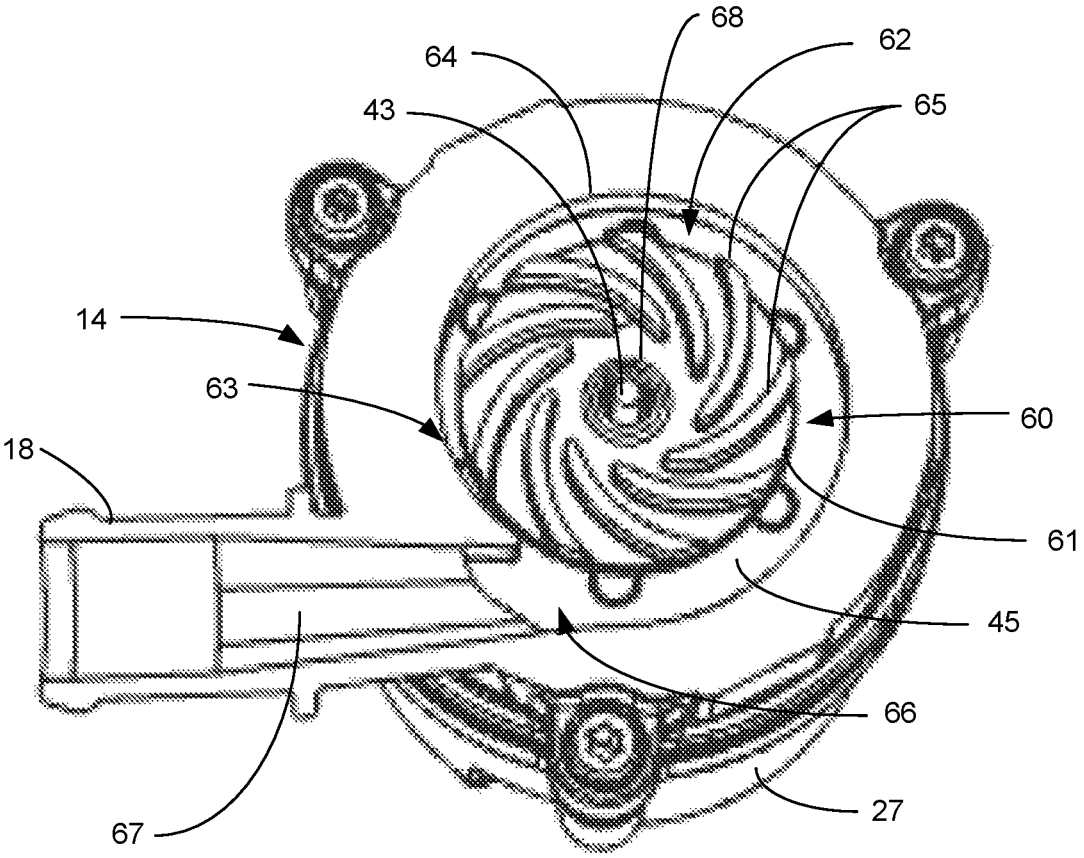
FIG. 4 illustrates a cross-sectional perspective top view of the pump section of the present disclosure.

The auxiliary fluid pump is formed by the components of pump section 14 of the upper housing 25. As is illustrated in FIG. 4, the auxiliary fluid pump comprises the impeller 60 rotating within a cylindrical pump cavity 62 formed by a circular wall 64. The impeller 60 is mounted in the pump cavity 62 slightly off-center forming a voluted flow path between the outer edges of the impeller vanes 65 and wall 64. The voluted flow path is arranged to accelerate the fluid flow from the pump cavity 62. The voluted path has a narrower fluid path at location 63 between the outer edges of impeller vanes 65 and wall 64 that expands to a wider fluid path at location 66 near passage 67. The voluted flow path leads to a passage 67 and fluid outlet 18. Rotation of the impeller 60 by motor shaft 43 causes fluid contained in pump cavity 62 to be discharged at an accelerated flow rate through passage 67 and out of fluid outlet 18.

When the mechanical pump is operated by the engine, coolant is pumped through the coolant circuit, and will flow into pump cavity 62 from the first fluid inlet 20. If the second fluid inlet 22 is switched into an open position by valve switch 80 coolant will also flow into pump cavity 62, if not, only the coolant delivered by the fluid inlet 20 will flow into pump cavity 62. The coolant in pump cavity 62 will exit the pump cavity 62 from the fluid outlet 18 and back into the coolant circuit, due to the flow through the coolant circuit provided by the mechanical pump. However, if the engine is in a stopped situation, the BLDC motor will be energized which rotates the impeller 60 to drive the coolant delivered to pump cavity 62 into passage 67 and out of fluid outlet 18. In the stopped situation, the mechanical pump driven by the engine is stopped and coolant is circulated through the coolant circuit only by the flow rate provided by the auxiliary fluid pump of pump section 14. As soon as the stop situation has ended, the mechanical pump resumes its operation upon restarting of the engine, and the operation of the auxiliary fluid pump is halted.

FIGS. 5-8 illustrate an exemplary valve switch 80 of the present disclosure installed in valve housing 16. The valve switch 80 is mounted in a cavity 121 of the valve housing 16. The cavity 121 extends through the upper housing 25 parallel to passage 21. The valve switch 80 is arranged to rotate within cavity 121 and cause the switching of coolant flowing through inlet 22 to either be directed to pump cavity 62 or to be blocked from reaching the pump cavity.

Figure 6:
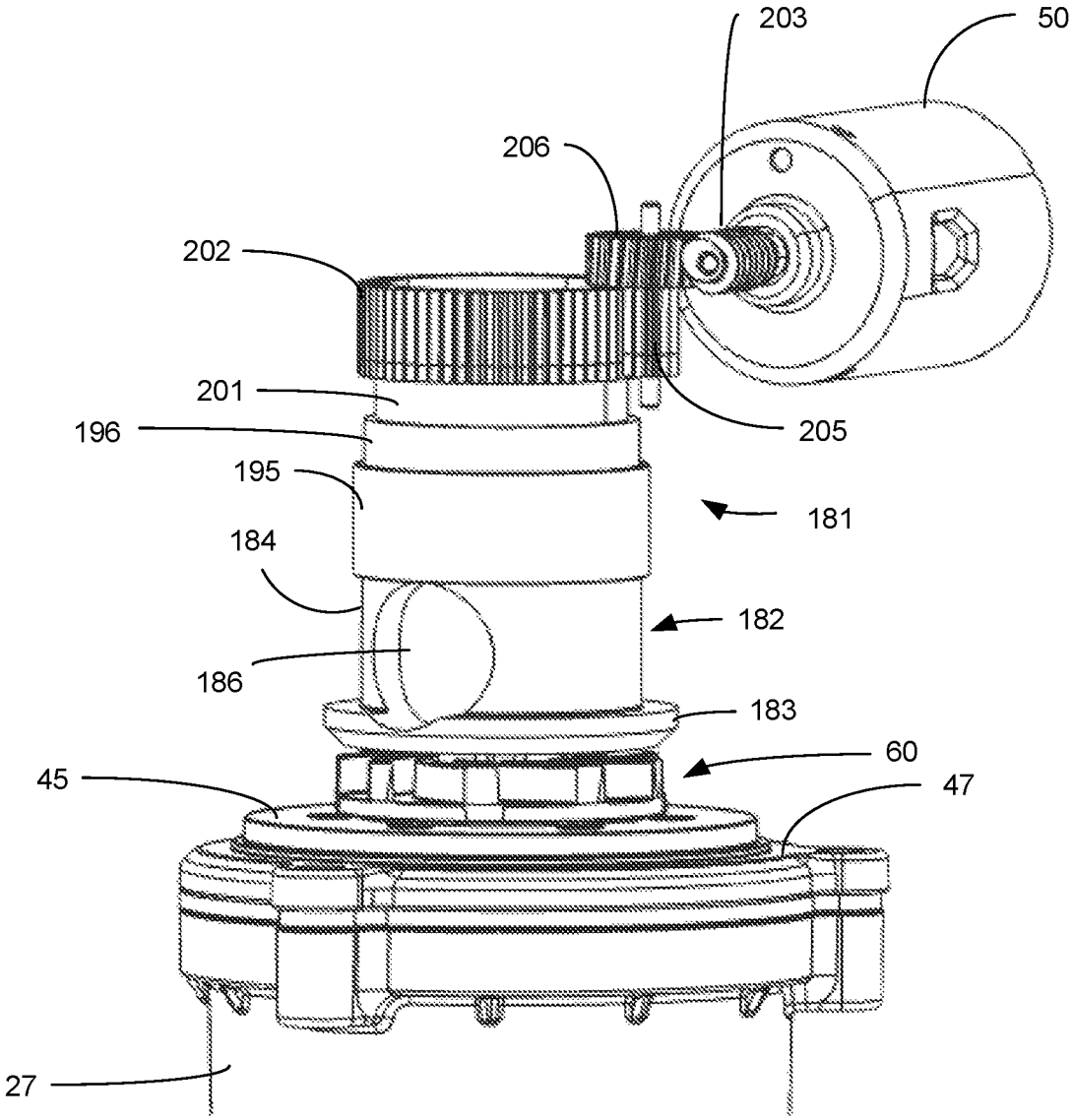
FIG. 6 illustrates a perspective view of the valve switch and actuator motor of the present disclosure.
Figure 7:
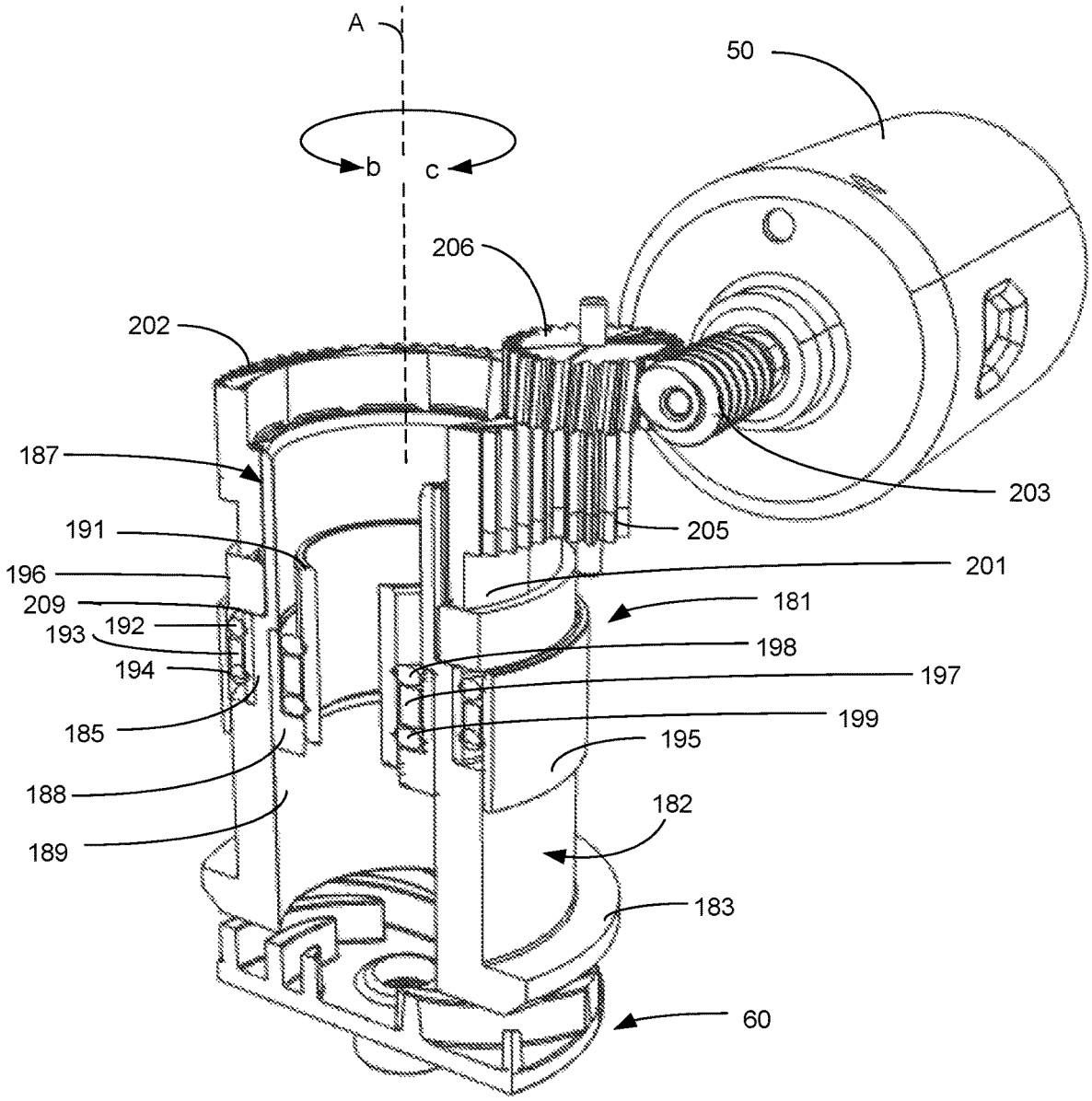
FIG. 7 illustrates a cross-sectional view of the valve switch and actuator motor of the present disclosure.

The exemplary valve switch 80 and actuator motor 50 are shown in FIGS. 6 and 7 isolated from the upper housing 25 of valve section 16 and the actuator cover 23. The example valve switch 80 comprises a tubular valve body 181 having an exterior wall 184. A lower portion 182 of valve body 181 includes an opening 186 that traverses through the wall 184 into the interior of lower portion 182 formed by a cylindrical interior surface 189. A circular lower bearing member 183 extends about an edge of the exterior wall 184 of lower portion 182 just below opening 186. A central portion of the valve body 181 includes a cylindrical external sealing section wall 185 that has a diameter that is less than the diameter of the wall 184 of the lower portion 182. The external sealing section wall 185 includes an exterior sealing assembly consisting of first and second elastomeric sealing members 192, 194 separated by a spacer 193 and an exterior circular flange 195 extending about the exterior sealing assembly. The exterior circular flange 195 is located circumferentially about the sealing section wall 185 and arranged to be accepted within a pocket 327 formed in cavity 121 of the upper housing 25.

The interior of the valve body 181 further includes an internal sealing assembly consisting of third and fourth sealing members 198, 199 separated by spacer 197. The internal sealing assembly is located on a shoulder area 188 that extends from the cylindrical interior surface 189 into the interior of the valve body 181. The internal sealing assembly is located parallel with and directly opposite from the external sealing assembly. An interior circular flange 191 extends around the internal sealing assembly. The interior circular flange 191 is arranged to fit within a recessed pocket 423 in passage 21. The external and the internal sealing assemblies are used to provide a fluid tight seal between the valve section 16 and the valve switch 80 when the valve switch 80 rotated. Sealing members 192, 194 and 198, 199 are comprised of, for example, O-rings fabricated from an elastomeric material such as Ethylene Propylene Diene Monomer (EPDM) rubber or the like.

The upper portion 187 of the valve body 181 further includes an upper bearing member 196 attached to the upper portion 187 and resting on shoulder 209. An actuation ring 201 includes a spline tooth gear band 202 attached to the upper portion 187 by press-fitting the actuation ring 301 to an outer surface of the upper section 187. As is shown in FIGS. 6 and 7 the teeth of the gear band 202 are arranged to be mechanically accepted and engaged with a toothed gear set having a first gear 205 engaged with gear band 202 and a second gear 206 attached to the first gear 205, engaged with a worm gear 203 attached to a rotatable actuator motor shaft of actuator motor 50. Worm gear 203 is rotated by the actuator motor shaft when actuator motor 50 is energized. The rotation of the worm gear 203 is mechanically transferred to gear set 206, 205 and to gear band 202 causing rotation of the valve body 181 about axis A. The valve body 181 may be rotated in either direction b or in direction c, based on the direction of rotation of the actuator motor shaft. The actuator motor 50 is electrically controlled to rotate the actuator motor shaft and worm gear 203 to cause rotation of the valve body 181 in the selected direction.

Figure 5:
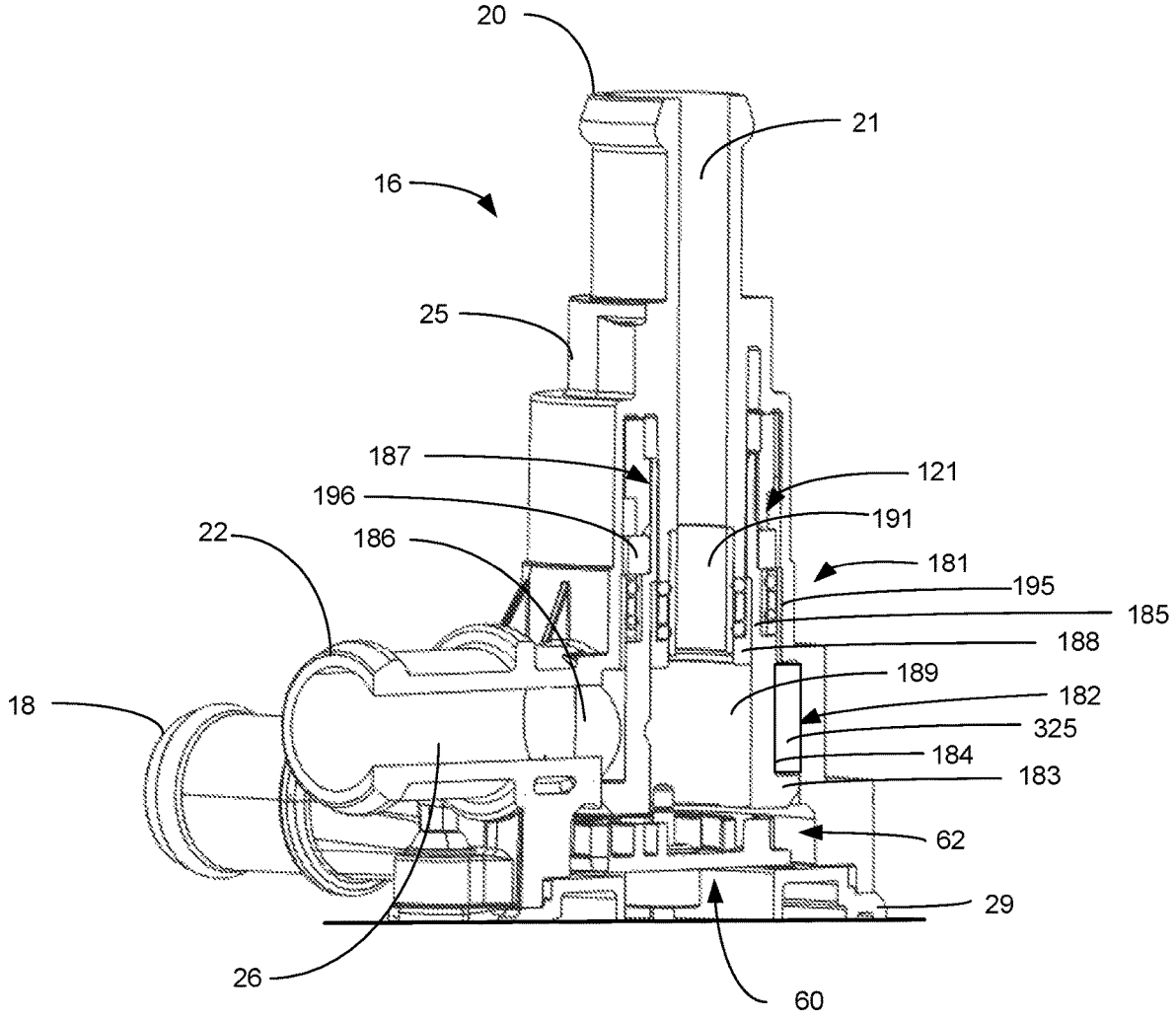
FIG. 5 illustrates a cross-sectional view through the valve section of the present disclosure.

With renewed reference to FIG. 5, the valve body 182 of the valve switch 80 is arranged to be rotated by the actuator motor 50 into a first position that aligns opening 186 with passage 26. The alignment causes coolant to flow from passage 26 through the opening 186 and into the interior of the lower body and the pump cavity 62. The valve switch member 80 is further arranged to be rotated by the actuator motor 50 into a second position that moves opening 186 away from passage 26 blocking the flow of coolant from passage 26 to the interior of the lower body and pump cavity 62.

Figure 8:
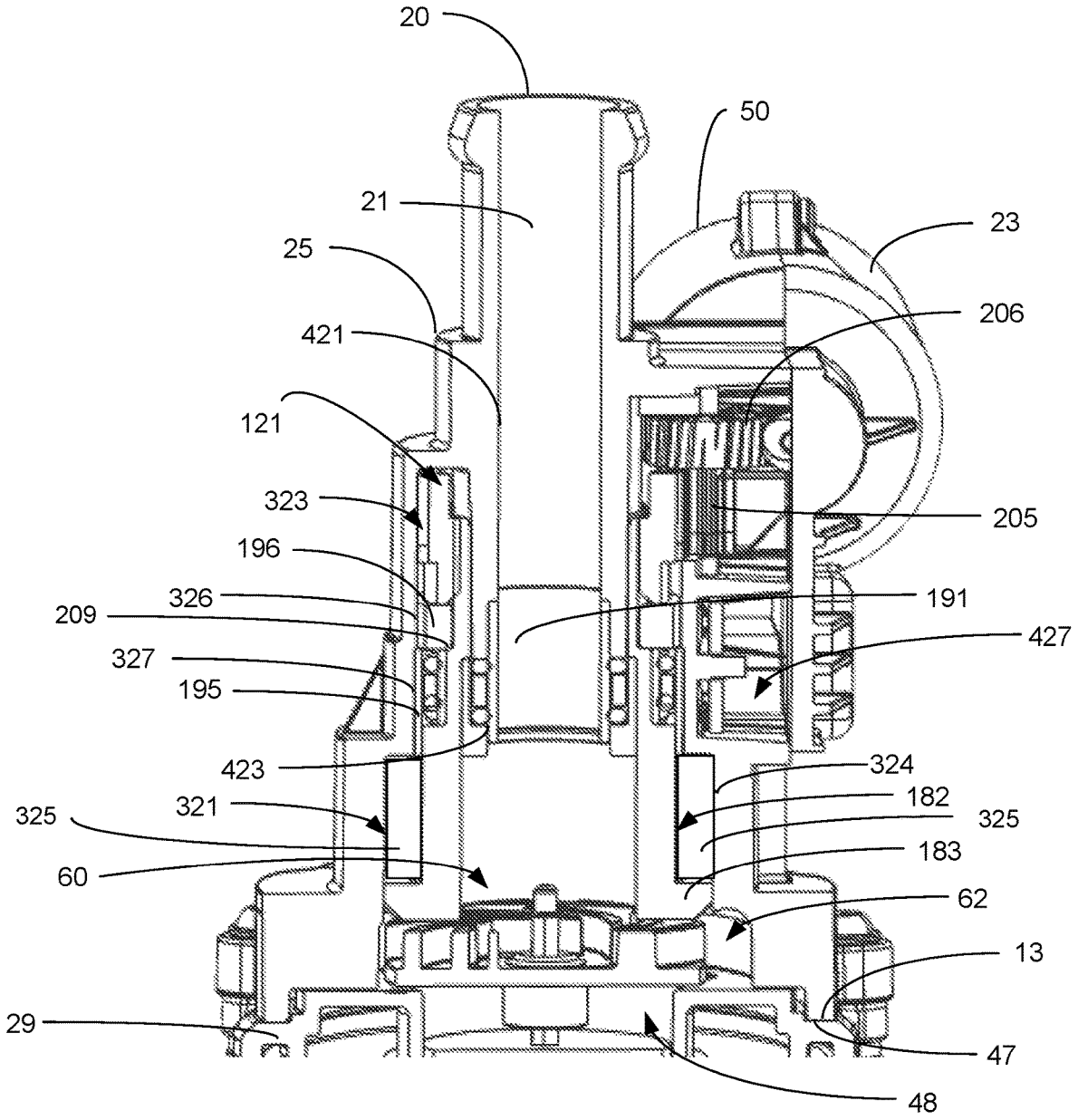
FIG. 8 illustrates a cross-sectional perspective view through the upper housing of the assembly of the present disclosure.

As is shown in FIG. 8, the valve switch 80 is arranged to be assembled within a stepped annular cavity 121 formed in the interior of the upper housing 25 of valve section 16. The cavity 121 includes a lower chamber 321 having a first cylindrical wall surface 324. The lower chamber 321 has a diameter that can accept the lower portion 182 of valve body 181, with a front face of lower bearing member 183 contacting the first cylindrical wall surface 324. An elastomeric sealing member 325 is installed in chamber 321. A sealing member 325 is placed in lower chamber 321 that aligns with passage 26 to prevent leaking of coolant into the interior of the lower body when the valve switch member 80 is placed into the second position that moves opening 186 away from passage 26. When the valve switch 80 is rotated by the actuator motor 50 the lower bearing member 183 front face travels against surface 324 retaining the valve switch member 80 in a centered in cavity 121 and passage 21. An upper chamber 323 is formed by a second cylindrical wall surface 326. Surface 326 further includes a cylindrical pocket 327 sized to accept within the pocket the exterior circular flange 195. A front face of the upper bearing 196 is accepted on the second cylindrical wall surface 326. Upon rotation of the valve switch 80 by the actuator motor 50 the upper bearing member 196 front face travels against surface 26 also adding in the retention of the valve stich member 80 centered in cavity 121 and passage 21.

Passage 21 includes cylindrical wall 421 that extend into the upper housing 25 parallel to cavity 121. Wall 421 includes a cylindrical pocket 423 sized to accept within the pocket 423 circular flange 191. Coolant flowing into passage 21 from fluid inlet 20 flows into the lower portion 182 of the valve body 181 and into pump cavity 62. As is shown in FIG. 8 the actuator moto 50 is housed in actuator housing 23 along with gear set 206 and 205 that are in turn engaged to worm gear 203.

The upper housing 25 of valve section 16 may further include an electronics section 427 that may house electronic components (not shown) for driving the actuator motor 50. Control signals to the actuator may be applied to the electronic components using an external connector (not shown) electrically connected to the electronic components of electronics section 427. Control signals may also be sent to actuator motor 50 using electrical conductors connected to terminals 72 of the external connector 70. An electrical connector can be communicatively connected to external connector 70 and terminals 72 to couple integrated control signals from an external controller for energizing and regulating the motor, and also controlling the position of actuator motor 50. The external controller arranged to send control signals using only one set of conductors to control both the electrical motor driving the auxiliary fluid pump and the actuator driving the valve switch, such as the apparatus and method taught by Applicants' copending patent application Ser. No. 17/828,767.

It may be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present application should not be read as implying that any particular element, step, or function is an essential or critical element that must be included in the claim scope. The scope of patented subject matter is defined only by the allowed claims. Moreover, none of the claims is intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," or "controller" within a claim is understood and intended to refer to structures known to those skilled in the relevant art, as further modified or enhanced by the features of the claims themselves and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An assembly comprising:

an upper housing having at least a first and a second fluid inlet;

a first fluid passage located in the upper housing for the unswitched delivery of fluid from the first fluid inlet to a pump cavity;

a valve switch for selectively switching the delivery of fluid from the second fluid inlet to the pump cavity;

a fluid outlet fluidically connected to the pump cavity;

an impeller located in the pump cavity; and an electrical motor for rotating the impeller on demand to accelerate the fluid in the pump cavity out of the fluid outlet.

2. The assembly of claim 1, wherein the valve switch includes a tubular valve body having an exterior wall and a valve body opening extending through the exterior wall to an interior of the valve body, the interior of the valve body in fluid communication with the first fluid passage and the pump cavity.

3. The assembly of claim 2, wherein the valve switch includes an actuation ring mounted to the valve body, the actuation ring including a gear band.

4. The assembly of claim 3, further comprising:

an actuator having a shaft;

a worm gear attached to the shaft;

a gear set mechanically engaging the worm gear and the gear band, wherein the actuator rotates the shaft and the worm gear and the gear set drives the gear band to rotate the valve body.

5. The assembly of claim 4, wherein the upper housing includes:

an annular cavity having a lower chamber defined by a first cylindrical wall surface and an upper chamber defined by a second cylindrical wall surface; and the valve body further includes a lower bearing member extending from the valve body exterior wall proximate the valve body opening and an upper bearing member extending from the valve body proximate the actuating ring, wherein a front face of the lower bearing member traverses on the first cylindrical wall surface and a front face of the upper bearing member rotatably traverses on the upper bearing surface when the valve body is rotated.

6. The assembly of claim 4, wherein the actuator selectively rotates the valve body to a first open position that locates the valve body opening in alignment with the second fluid inlet allowing fluid to flow from the second fluid inlet to the pump cavity.

7. The assembly of claim 4, wherein the actuator selectively rotates the valve body to a second closed position that locates the valve body opening not in alignment with the second fluid inlet blocking fluid to flow from the second fluid inlet to the pump cavity.

8. The assembly of claim 2, wherein the impeller comprises a base plate and a plurality of impeller vanes extending from the base plate.

9. The assembly of claim 8, wherein pump cavity is enclosed by a circular wall and the impeller base plate is located off-center in the pump cavity forming a voluted flow path between outer edges of the impeller vanes and the pump cavity wall.

10. The assembly of claim 9, wherein the fluid outlet includes a second fluid passage fluidically connected to the valve body opening and wherein the distance of the voluted flow path between the outer edges of the impeller vanes and the pump cavity wall is the greatest at an inlet of the second fluid passage.

11. The assembly of claim 8, wherein the assembly further includes a lower housing attached to an intermediate cover member and to the upper housing, the intermediate cover member including a first portion forming a floor of the pump cavity.

12. The assembly of claim 11, wherein the bottom surface of the intermediate cover member opposite the first portion includes a chamber extending into an interior space of the lower housing.

13. The assembly of claim 12, wherein the chamber includes a motor shaft having a first end rotationally attached to a support member located on a floor of the chamber, and a second end fixedly attached to an attachment member of the impeller base plate.

14. The assembly of claim 13, wherein the motor shaft is arranged to be rotated by a rotating component of the electrical motor, wherein the rotation of the motor shaft rotates the impeller.

15. The assembly of claim 14, wherein the interior space of the lower housing includes:

an electrical motor energizing component that drives the rotating component;

a connector housing; and a set of electrical terminals that extend through the connector housing and that are electrically connected to the energizing component, wherein the electrical terminals are arranged to be connected to a source of control signals and electrical energy.

16. The assembly of claim 15, wherein upon receiving the control signals and electrical energy the electrical motor energizing component is activated to rotate the rotating component of the electrical motor and the motor shaft.

17. The assembly of claim 7, wherein the actuator comprises:

an electrical actuator motor connected to an actuator motor shaft;

an electrical section having electronic components housed in the upper housing, the electrical components communicatively connected to a source of control signals, wherein the control signals activate the actuator motor to selectively rotate the actuator motor shaft to move the valve body to the first open position or alternately the second closed position.

18. The assembly of claim 17, wherein an electrical connector is used to apply the control signals to the actuator electrical components.

19. The assembly of claim 11, wherein the upper housing, lower housing and intermediate cover member are formed from a suitable glycol and temperature resistant thermoplastic material.

20. An assembly comprising:

an upper housing having at least a first and a second fluid inlet for directing a fluid to a pump cavity;

a valve switch for selectively switching the flow of the fluid between the second fluid inlet and the pump cavity;

an external sealing assembly located circumferentially about the perimeter of a cylindrical sealing section wall;

an internal sealing assembly located circumferentially about the perimeter of an interior shoulder area that extends into an interior of the valve switch, the internal sealing assembly located parallel to the external sealing assembly;

a fluid outlet fluidically connected to the pump cavity;

an impeller located in the pump cavity; and an electrical motor for rotating the impeller to accelerate the fluid in the pump cavity out of the fluid outlet.

21. An assembly comprising;

an upper housing having at least a first and a second fluid inlet for directing a fluid to a pump cavity and an annular cavity having a lower chamber defined by a first cylindrical wall surface and an upper chamber defined by a second cylindrical wall surface;

a valve switch for selectively switching the flow of the fluid between the second fluid inlet and the pump cavity, the valve switch including a lower bearing member and an upper bearing member;

an actuator arranged to rotate the valve switch to control the flow of fluid between the second fluid inlet and the pump cavity and wherein the lower bearing member rotatably traverses on the first cylindrical wall surface and the upper bearing member rotatably traverses on the upper bearing surface when the valve switch is rotated by the actuator;

a fluid outlet fluidically connected to the pump cavity;

an impeller located in the pump cavity; and an electrical motor for rotating the impeller to accelerate the fluid in the pump cavity out of the fluid outlet.

* * * * *